US008175305B2

(12) United States Patent
Chew et al.

(10) Patent No.: US 8,175,305 B2
(45) Date of Patent: May 8, 2012

(54) HEARING AID WITH A DROP SAFEGUARD

(75) Inventors: Leep Foong Chew, Singapore (SG); Meng Kiang Lim, Singapore (SG); Chow Lan Stella Yap, Singapore (SG)

(73) Assignee: Siemens Medical Instruments Pte. Ltd., Singapore (SG)

( * ) Notice: Subject to any disclaimer, the term of this patent is extended or adjusted under 35 U.S.C. 154(b) by 393 days.

(21) Appl. No.: 12/420,844

(22) Filed: Apr. 9, 2009

(65) Prior Publication Data

US 2009/0257608 A1 Oct. 15, 2009

(30) Foreign Application Priority Data

Apr. 9, 2008 (DD) ..... 10 2008 018 039

(51) Int. Cl.
*H04R 25/00* (2006.01)

(52) U.S. Cl. ..... 381/312; 381/314; 381/322; 381/328; 381/330; 381/60; 381/55; 381/56; 381/57

(58) Field of Classification Search ..... 381/60, 381/312, 330, 55–57, 314, 322, 328
See application file for complete search history.

(56) References Cited

U.S. PATENT DOCUMENTS

| | | | | |
|---|---|---|---|---|
| 6,330,339 | B1 | 12/2001 | Ishige et al. | |
| 2008/0154098 | A1 * | 6/2008 | Morris et al. | 600/300 |
| 2008/0187163 | A1 * | 8/2008 | Goldstein et al. | 381/380 |

FOREIGN PATENT DOCUMENTS

| | | | |
|---|---|---|---|
| DE | 10145994 | A1 | 4/2003 |
| DE | 102006028682 | A1 | 1/2008 |

* cited by examiner

*Primary Examiner* — Jerome Jackson, Jr.
*Assistant Examiner* — Yu Chen
(74) *Attorney, Agent, or Firm* — Laurence A. Greenberg; Werner H. Stemer; Ralph E. Locher

(57) ABSTRACT

A hearing aid with a drop safeguard has an accelerometer, an electrical circuit, and a memory. The accelerometer generates an electrical signal in dependence on an acceleration of the hearing aid. The signal is transmitted to the electrical circuit which uses this to determine a jerky acceleration of the hearing aid. The electrical circuit saves the respectively current settings of the hearing aid to the memory in the case of a jerky acceleration of the hearing aid. After the hearing aid is dropped, the settings can be reconstructed from the memory so that as a result this prevents the settings of the hearing aid from being changed.

17 Claims, 1 Drawing Sheet

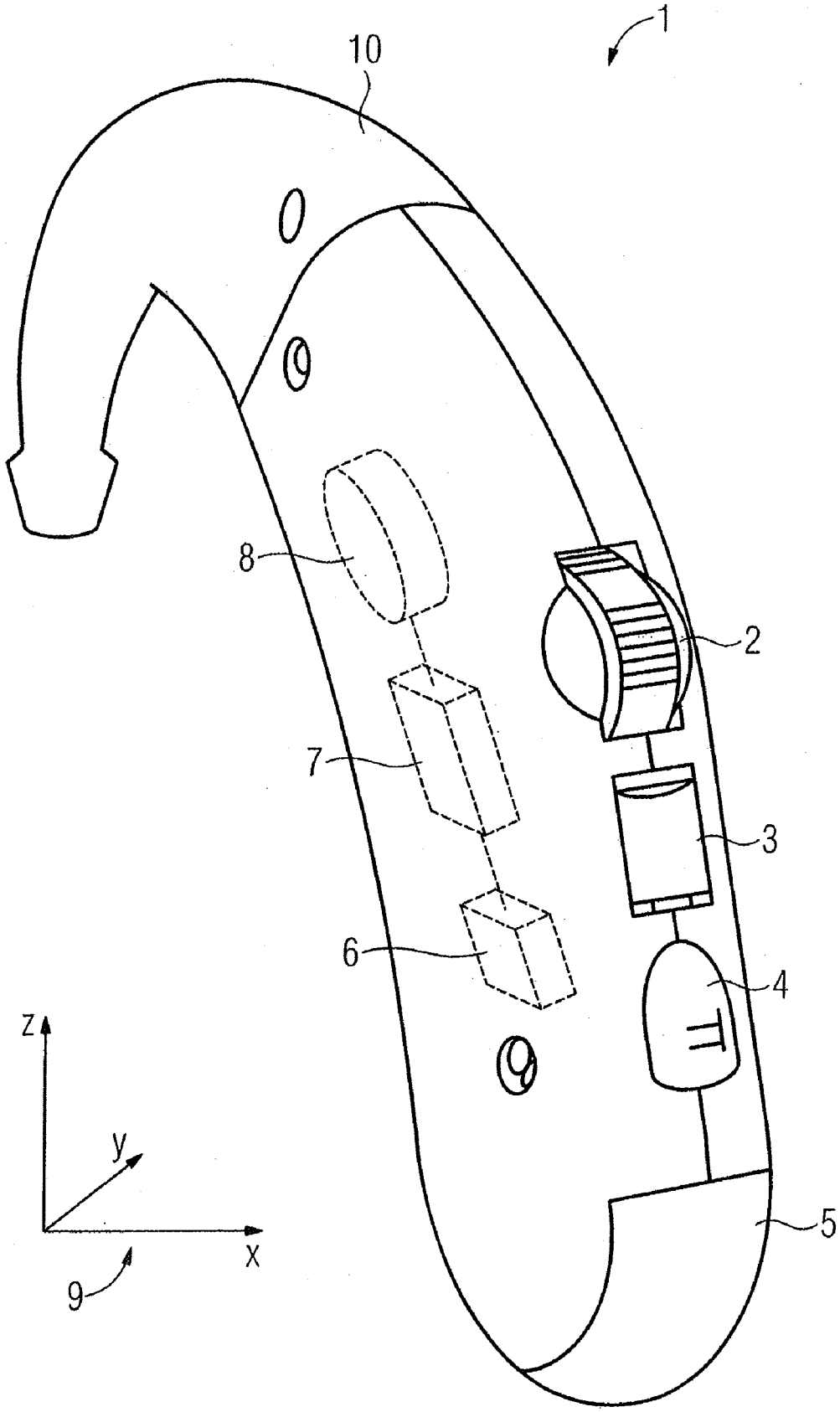
1
10
8
2
7
3
6
4
5
z
y
x
9

HEARING AID WITH A DROP SAFEGUARD

CROSS-REFERENCE TO RELATED APPLICATION

This application claims the priority, under 35 U.S.C. §119, of German patent application DE 10 2008 018 039.4, filed Apr. 9, 2008; the prior application is herewith incorporated by reference in its entirety.

BACKGROUND OF THE INVENTION

Field of the Invention

The invention relates to a hearing aid and, more specifically, to a hearing aid with a drop safeguard.

Hearing aids for people who are hard of hearing are generally worn on the ear. When attaching the hearing aid, or removing the hearing aid, said hearing aid can easily fall to the ground. This can also happen when the hearing aid sits insecurely on the ear and can thus be released on its own accord.

Hearing aids comprise sensitive electronics which can be damaged on impact with the ground. Moreover, the current settings can be changed upon impact of the hearing aid. This can be the result of both mechanical adjustment of the controllers on the hearing aid and of direct effects of the impact acceleration on the electronics of the hearing aid.

In this case, all settings and functions of the hearing aid or the signal processing device of the hearing aid can be of interest. Examples include the volume, the classification parameters for classifying the respectively prevalent ambient sound into different classes, the respectively current classified ambient sound, the parameters of the noise suppression, the parameters of the directionally-dependent processing of microphone signals (directionality), the respectively active signal processing program (hearing program), or the parameters of a wireless or other data connection of the hearing aid to external devices such as a telephone, mobile telephone, entertainment electronics, remote control, programming equipment, or household electronics.

Furthermore, the parameters of learnable or self-adaptive settings of the hearing aid are of particular interest. These are settings that the hearing aid has "learned" to undertake itself on the basis of previous user inputs or those parameters that the hearing aid has learned on the basis of previous user inputs in order to be able to undertake settings on the basis thereof in an automated fashion. The parameters can in each case be pronounced to a different extent in different frequency bands or in different level stages, with it likewise being possible for the hearing aid to determine user requirements with respect to such dependencies from previous user inputs and to undertake independent settings based on said requirements. An example of this is setting the volume, which the hearing aid can adapt independently in accordance with user wishes determined from previous inputs. A further example is setting the volume in the context of the respectively classified ambient sound, e.g. the hearing aid independently raises or lowers the volume if a certain ambient sound is classified in accordance with previous user inputs.

Previously, this object was achieved by a mechanically robust design of the hearing aid. Design measures which increase the robustness of the hearing aid include, for example, separate housings for the essential electronic components such as receiver, microphone and amplifier, supporting bracing within the housing, accurately fitting moldings of the housing to the electrical components and a multiplicity of solid solder and adhesive connections for the components of the hearing aid.

However, the abovementioned design measures result in a heavier hearing aid and a more complex and hence costly production of the hearing aid.

To protect the hearing aid settings from changes as a result of a drop, the setting controllers must be designed such that they cannot be adjusted as a result of the momentum of an impact. As a result of this, changing the aid settings by hand is disadvantageously made more difficult.

German published patent application DE 10 2006 028 682 A1 discloses a hearing aid with a sensor assembly. The sensor assembly can, inter alia, be suited to measure accelerations. It is used to detect surrounding conditions in order to automatically control the hearing aid as a function thereof. In this case, the control can relate to a directional characteristic (directionality) or an on/off function or the volume. What the variables to be controlled automatically have in common is that they are usual operating settings of the hearing aid in fault-free operating conditions.

SUMMARY OF THE INVENTION

It is accordingly an object of the invention to provide a hearing aid with a drop safeguard which overcomes the above-mentioned disadvantages of the heretofore-known devices and methods of this general type and which offers simple protection against a changing of the settings of the hearing aid.

With the foregoing and other objects in view there is provided, in accordance with the invention, a hearing aid with a drop safeguard, comprising:

an accelerometer for generating an electrical output signal in dependence on an acceleration of the hearing aid;

an electrical circuit for determining a jerky acceleration of the hearing aid based on the output signal of the accelerometer; and a memory for saving settings of the hearing aid connected to the electrical circuit;

the electrical circuit being configured to save current settings of the hearing aid to the memory on occasion of a jerky acceleration of the hearing aid.

An accelerometer, which effects automatic saving of the respectively current settings of the hearing aid by means of an electronic circuit in the case of a jerky acceleration, makes it possible to easily restore the settings from the memory after an impact of the hearing aid. Thus, after an impact, the invention immediately undoes any change of the settings as a result of the impact. The term "jerky" is to be understood in a sense of "sudden" and jerky acceleration should be understood as being represented by a steep acceleration curve.

Applying the invention to the commonly used settings of volume and respective hearing program is particularly advantageous.

The accelerometer can be any type of sensor which can directly or indirectly infer a jerky acceleration or measure an impact of the hearing aid on an object.

A three-axis accelerometer, which can measure accelerations along three orthogonal axes, is a particularly effective accelerometer. By way of example, such sensors are used in securing mobile hard disk drives. For example, Hitachi uses such sensors in at least some Microdrive hard disks under the name of "Extra Sensory Protection".

However, the accelerometer can also be in the form of a microphone which in any case is provided on the hearing aid. If the microphone measures a volume level or a sound frequency spectrum which is characteristic of an impact of the hearing aid, this provides an indirect measurement of a jerky acceleration.

Other features which are considered as characteristic for the invention are set forth in the appended claims.

Although the invention is illustrated and described herein as embodied in a hearing aid with a drop safeguard, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The sole FIGURE is a diagrammatic view of a hearing aid according to the invention which comprises a drop safeguard with an accelerometer.

DETAILED DESCRIPTION OF THE INVENTION

Referring now to the FIGURE of the drawing in detail, the apparatus according to the invention is a hearing aid 1 with a volume controller 2, a programming socket 3, a program button 4 with on/off operation, a battery compartment 5, and a microphone 10. An accelerometer 6, an electrical circuit 7, and a memory 8 are disposed inside the hearing aid 1. That is, they are invisible form the outside The accelerometer 6 is in the form of a three-axis accelerometer for measuring an acceleration of the hearing aid 1 along three orthogonal axes 9. By means of an electronic line, the accelerometer 6 transmits signals to the electrical circuit 7 regarding the respectively measured acceleration. The electrical circuit 7 determines a "jerky" acceleration of the hearing aid 1 based on these signals.

So that normal accelerations, which for example are caused by movements of the wearer of the hearing aid 1 or by setting the hearing aid 1, can be distinguished from accelerations caused by the hearing aid 1 being dropped, the electrical circuit 7 is only active if the magnitude of the measured acceleration exceeds a predetermined threshold value. The threshold value represents the boundary between normal accelerations and accelerations caused by the impact of the hearing aid 1.

If the electrical circuit 7 determines a jerky acceleration of the hearing aid 1, it saves the respectively current settings to the memory 8 connected to the circuit 7. Saving is effected so quickly that it has not yet been possible for any settings to have been changed by the drop.

It is also possible for the circuit 7 to save the current settings to the memory 8 at regular intervals (e.g. every tenth of a second) and, in the case of a drop, to restore these last saved settings prior to being dropped after the drop. This makes particularly reliable saving of the settings possible, even if the electrical circuit 7 should work comparatively slowly.

As an alternative, or in addition, to the three-axis accelerometer, it is possible for the electrical circuit 7 to also make use of sounds measured by the microphone 10. An impact of the hearing aid on a hard object causes the microphone 10 to record a loud sound with a characteristic spectrum.

The spectrum depends on the composition of the housing of the hearing aid 1 but in general covers a broad frequency spectrum, like most banging sounds.

The sound also differs from other sounds, which are generated, for example, by putting on the hearing aid 1, in terms of its volume and, in particular, the profile of the volume. The sound of the impact is comparatively loud and short. This makes it possible for the microphone 10 to indirectly reliably verify the acceleration due to the impact. It is in this sense that the microphone 10 is operated as an impact sensor.

A coincidence circuit between the accelerometer 6 and the microphone 10 makes it possible to detect the impact particularly reliably.

The present exemplary embodiment relates to a mechanical volume controller 2 in the form of a rotating wheel. The program button 4 is likewise a mechanical switch in the form of a sliding switch, which can be displaced upward and downward to select the desired hearing program. The volume controller 2 and/or the program button 4 can also be designed in the form of electronic push buttons.

The electronic circuit 7 of the drop safeguard can be both a separate circuit and a circuit integrated into the rest of the hearing aid electronics.

The memory 8 may, for example, be in the form of an EEPROM.

In conclusion, an exemplary embodiment of the invention relates to a hearing aid with a drop safeguard comprising an accelerometer, an electrical circuit and a memory. The accelerometer generates an electrical signal as a function of an acceleration of the hearing aid. This signal is transmitted to the electrical circuit which uses this to determine a jerky acceleration of the hearing aid. The electrical circuit saves the respectively current settings of the hearing aid to the memory in the case of a jerky acceleration of the hearing aid. After the hearing aid is dropped, the settings can be reconstructed from the memory so that as a result this prevents the settings of the hearing aid from being changed.

The invention claimed is:

1. A hearing aid with a drop safeguard, comprising:

an accelerometer for generating an electrical output signal in dependence on an acceleration of the hearing aid;

an electrical circuit for determining a jerky acceleration of the hearing aid based on the output signal of the accelerometer; and a memory for saving settings of the hearing aid connected to said electrical circuit, the settings being selected from the group consisting of a volume adjustment setting of the hearing aid and a hearing program adjustment setting of the hearing aid;

said electrical circuit being configured to save current settings of the hearing aid to said memory on occasion of a jerky acceleration of the hearing aid.

2. The hearing aid according to claim 1, wherein said circuit is configured to restore, following the jerky acceleration of the hearing aid, the settings of the hearing aid to a state of the settings previously saved to the memory.

3. The hearing aid according to claim 1, wherein said circuit is configured to save the settings at regular intervals and, on occasion of a jerky acceleration, to restore the settings of the hearing aid to the state of the settings last saved to the memory prior to the jerky acceleration.

4. The hearing aid according to claim 1, wherein said accelerometer is a three-axis accelerometer for measuring an acceleration of the hearing aid along three mutually orthogonal axes.

5. The hearing aid according to claim 1, wherein said circuit is configured to save the settings if a magnitude of the acceleration exceeds a predetermined threshold value.

6. The hearing aid according to claim 1, wherein said accelerometer is a microphone measuring an acceleration occurring when the hearing aid is dropped on a basis of an impact sound of said hearing aid.

7. The hearing aid according to claim 6, wherein said circuit is configured to save the settings if the volume recorded by the microphone exceeds a predetermined level.

8. The hearing aid according to claim 6, wherein said circuit is configured to save the settings if the sound recorded by the microphone has a spectrum that is characteristic of an impact of the hearing aid.

9. The hearing aid according to claim 1, wherein said memory is designed for saving settings relating to parameters of the hearing aid determined by previous user inputs, on the basis of which parameters the hearing aid can independently set settings.

10. A method of operating a hearing aid, comprising:

providing a hearing aid with an accelerometer for generating an electrical output signal in dependence on an acceleration of the hearing aid;

monitoring the output signal of the accelerometer with an electrical circuit and determining whether or not the output signal indicates a jerky acceleration of the hearing aid; and on occasion of a jerky acceleration of the hearing aid determined by the electrical circuit, saving current adjustment settings of the hearing aid into a memory connected to the electrical circuit, the adjustment settings being selected from the group consisting of a volume adjustment, a hearing program adjustment, and parameters of the hearing aid determined by previous user input.

11. The method according to claim 10, which comprises, following the jerky acceleration of the hearing aid, restoring the adjustment settings of the hearing aid to a state of the settings previously saved to the memory.

12. The method according to claim 10, which comprises saving the adjustment settings at regular intervals and, on occasion of a jerky acceleration, restoring the settings of the hearing aid to a state of the settings last saved to the memory prior to the jerky acceleration.

13. The method according to claim 10, which comprises saving the adjustment settings if a magnitude of the acceleration exceeds a predetermined threshold value.

14. The method according to claim 10, which comprises measuring the acceleration with a microphone recording an impact sound of the hearing aid when the hearing aid is dropped.

15. The method according to claim 14, which comprises saving the adjustment settings when a volume recorded by the microphone exceeds a predetermined level.

16. The method according to claim 14, which comprises saving the adjustment settings if the sound recorded by the microphone has a spectrum that is characteristic of an impact of the hearing aid.

17. The method according to claim 10, which comprises saving the settings relating to parameters of the hearing aid determined by previous user inputs, on the basis of which parameters the hearing aid can independently set settings.

* * * * *